United States Patent [19]

Whitney, Jr.

[11] Patent Number: 4,819,401

[45] Date of Patent: Apr. 11, 1989

[54] WIRE ANCHOR FOR METAL STUD/BRICK VENEER WALL CONSTRUCTION

[76] Inventor: G. Ward Whitney, Jr., 2129 Lockhart Dr., Charlotte, N.C. 28203

[21] Appl. No.: 179,054

[22] Filed: Apr. 8, 1988

[51] Int. Cl.[4] ..... E04B 1/38

[52] U.S. Cl. ..... 52/713; 52/487; 52/410; 52/714

[58] Field of Search ..... 52/487, 713, 712, 410, 52/359, 360, 358

[56] References Cited

U.S. PATENT DOCUMENTS

| | | | |
|---|---|---|---|
| D. 31,136 | 7/1899 | Wagor | 52/712 |
| 814,134 | 3/1906 | Hood | 52/714 |
| 1,596,291 | 8/1926 | Nadon | 52/360 |
| 1,693,949 | 12/1928 | Grimm | 52/360 |
| 1,859,946 | 5/1932 | Wilson | 52/360 |
| 2,322,657 | 6/1943 | Olsen | 52/359 |
| 2,921,464 | 1/1960 | Olsen | 52/359 |
| 3,300,939 | 1/1967 | Brynjolfsson | 52/713 |
| 3,553,915 | 1/1971 | Passovoy | 52/359 |
| 3,964,226 | 6/1976 | Hala | 52/713 |
| 4,433,524 | 2/1984 | Matson | 52/713 |

OTHER PUBLICATIONS

"Technical Notes on Brick Construction", No. 28B, revised II, of the Brick Institute of America, Reston, Virginia.

*Primary Examiner*—Henry E. Raduazo

*Attorney, Agent, or Firm*—Brumbaugh, Graves, Donohue & Raymond

[57] ABSTRACT

A wire anchor comprises a member having a U-shaped portion, the legs of which span the air space between the veneer wall and a stud, a transverse offset portion on each leg that engages the external face of the stud, and a pair of attachment portions that resiliently snap into a retained position on the stud. One of the attachment portions includes an inturned part defining a slot that is captured by the free edge of the inturned leg part of the stud. Both attachment portions include arms that engage the web portion and inturned leg part, respectively, of the stud.

5 Claims, 2 Drawing Sheets

WIRE ANCHOR FOR METAL STUD/BRICK VENEER WALL CONSTRUCTION

BACKGROUND OF THE INVENTION

Brick has long been a popular facing material for residential and commercial buildings. It is strong, durable, non-combustible and weather-resistant and requires little maintenance. Commonly, brick wall facing is provided in the form of a veneer wall. In a veneer wall, by definition, the facing is securely attached to a back-up structure but is not united with it such as to act in concert with the back-up in bearing applied loads.

A widely used back-up wall for commercial buildings is one based on steel studs, a gypsum wallboard exterior sheathing and a rigid plastic foam insulation applied over the sheathing. The brick veneer facing wall is carried on structural steel shelf angles at each story and is secured to the back-up wall, with an air space of 1" to 3" between it and the back-up wall, by anchors (sometimes called wall ties) located at 16-inch spacing vertically and either 16" or 24" spacing horizontally. The anchors are critical elements of the system, for they must support the veneer wall by transfer of lateral loads from the veneer wall to the back-up wall. Failure of the anchors means failure of the wall.

One type of anchor is a simple metal band corrugated transversely and bent into an "L" shape. The end portion of one leg of the "L" is embedded in a horizontal mortar joint of the brick veneer wall, and the other leg is fastened to the steel stud by screws. Another type of anchor comprises a slotted bracket that is welded or fastened by screws to the stud and receives a wire anchor member in a manner that allows vertical adjustment and movement of the anchor relative to the bracket.

The use of screws to fasten the anchor to the studs has recently been questioned. The presence of moisture due to leakage and condensation is inevitable, and corrosion of the screw threads is likewise inevitable. Corrosion-resistant coatings on the screws are disturbed when the screws are driven. Working of the screws weakens their hold to the stud. Often, screw-fastened brackets are fastened on the face of the sheathing, which makes installation easier but also undesirably loads the sheathing and the screws. While welding provides the requisite strength, it is costly and requires complicated notching of the sheet rock and insulation, to expose the brackets.

In *Technical Notes on Brick Construction,* No. 28B, Revised II, February 1987, of the Brick Institute of America, Reston, Virginia, two designs for anchors are proposed in which one anchor element, either a wire or a plate, is fitted to the stud flange and a second element is attached to the first for vertical adjustment and movement and is embedded in the motor joint. While those designs should provide longlife, as compared to screws, they are cumbersome in use, in that the first element has to be assembled to the stud before the stud is assembled to the back-up wall. In other words all of the anchor elements, which will usually be six or more, that are fitted to the stud have to be placed on the stud before the stud is erected. The chance of errors and omissions is great.

SUMMARY OF THE INVENTION

An object of the invention is to provide an anchor for a metal stud/brick veneer wall that properly secures the veneer wall to the studs without any screws and without preassembly to the studs before they are erected. Another object is to provide an anchor that is easy to install either as the sheathing and insulation are installed or as the brick veneer wall is constructed, thus providing flexibility in the progress of the job and in selection of the trade that installs the anchor. Yet a further object is to provide an anchor that can be manufactured economically with machinery currently used by suppliers and relatively inexpensive tooling.

The foregoing and other objects are met, in accordance with the present invention, by a wire anchor comprising a member bent from metal wire and having a generally U-shaped external portion adapted to span and maintain a space between a stud and a brick veneer wall and a pair of attachment portions adapted to be snapped into a retained position on the stud, which stud includes a web portion and a pair of L-shaped flange portions, each having a base leg part and an inturned leg part. Each attachment portion is joined integrally to a respective leg of the external portion at a juncture that includes a transverse offset portion engageable with an external portion of the outward base leg part of the stud. One attachment portion further includes an arm engageable with the external surface of the web portion of the stud, and the other attachment portion includes an arm engageable with the external surface of the inturned leg part of the stud and an inturned portion defining a slot adapted to snap resiliently onto and be captured by the free edge of the inturned leg part.

In preferred embodiments the external portion of the member may include an integral end portion adapted to be embedded in a mortar joint of the brick veneer wall. Each attachment portion may include an outwardly turned terminal part adapted to impale fiber batting insulation installed between the studs. The wire anchor may further comprise a second member bent from metal wire and including a portion adapted to be embedded in a mortar joint of the brick veneer wall and means on the respective members forming a vertical slip joint between them. For example the slip-joint may include a bar welded to the U-shaped portion of the first member to define a slot and leg portions on the second member integral with and bent orthogonally to the embedded portion of the second member and receivable in the slot.

For a better understanding of the invention reference may be made to the following description of exemplary embodiments of the invention, taken in conjunction with the figures of the accompanying drawings.

DESCRIPTION OF THE EMBODIMENT

Figure 1:
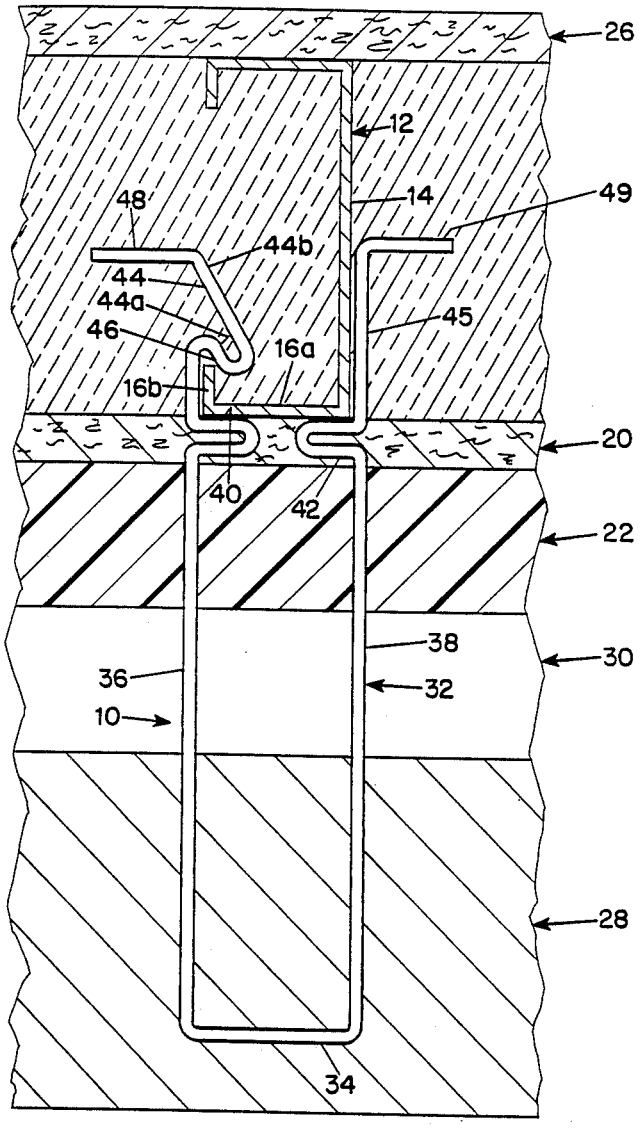
FIG. 1 is a fragmentary horizontal cross-sectional view of a wall employing a first embodiment.
Figure 2:
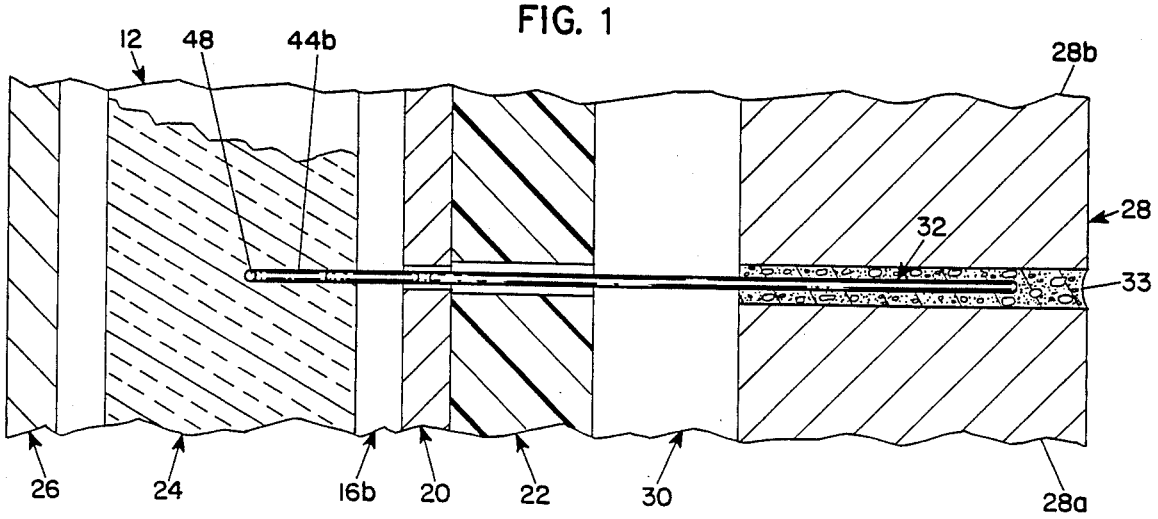
FIG. 2 is a fragmentary vertical cross-sectional view of the wall of FIG. 1.

FIGS. 1 and 2 show a wire anchor 10 embodying the invention in place in a typical metal stud/brick veneer back-up wall. The back-up wall is constructed of vertical metal studs 12 installed on 16" or 24" centers between the adjacent floors at the building perimeter.

Each stud comprises, in cross-section, a web portion 14 and a pair of L-shaped flange portions 16 and 18. Each flange portion includes a base leg part 16*a*, 18*a* and an inturned leg part 16*b*, 18*b*. Sixteen-inch by eight-foot asphalt-impregnated gypsum wallboard sheathing panels 20 are installed horizontally on the exterior of the studs using sheathing screws, and 16″×4′ rigid plastic insulation panels 22 are installed over the sheathing using an adhesive. The joints between the sheathing and the insulation panels establish the 16″ vertical spacing for the anchors 10, which are located on each stud at each sheathing/insulation joint; the 16″ or 24″ spacings of the studs establish the required 16″ or 24″ horizontal spacing of the anchors 10. Fiber batt insulation blankets 24 are installed between the studs, and the interior wall is finished with interior gypsum wallboard panels 26.

The brick veneer wall 28 is constructed on a structural steel shelf angle (not shown) at each floor - except that the ground floor veneer wall is usually located on a foundation shelf. Flashing and weep holes at the bottom of each veneer wall section allow water that intrudes by leakage or forms from condensation to exit the minimum two inch air space 30 between the back-up wall and the veneer wall.

The wire anchor 10 is bent from a single length of wire, such as 3/16 inch steel wire, to define an elongated U-shaped external portion 32, the base or loop end part 34 of which is embedded in a horizontal mortar joint 33 of the veneer wall 28 and the legs 36 and 38 of which span the air space 30 and extend in through the foam insulation 22. A pair of loops are formed in legs 36 and 38 of the wire to present offset portions 40 and 42 that engage external surfaces of the base leg part 16*a* of the stud.

Figure 5A:
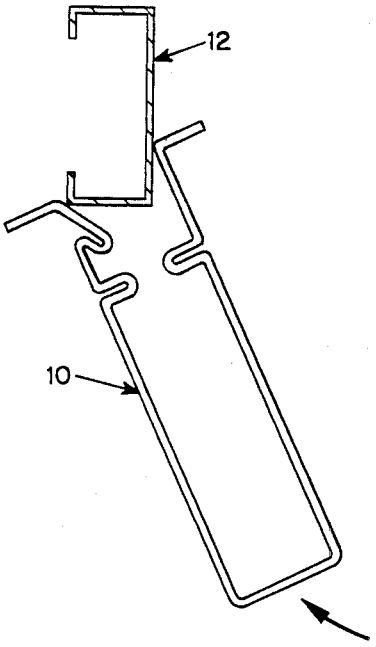
FIGS. 5A to 5C are diagrammatic views showing how the wall anchor is installed on the stud.
Figure 5B:
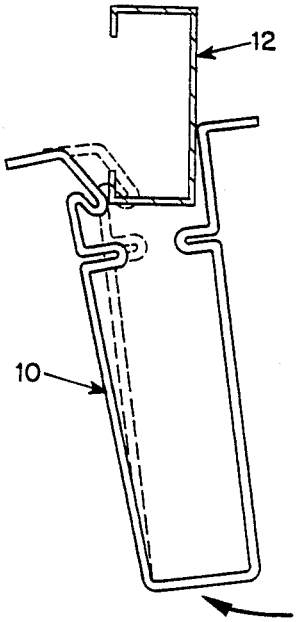
Figure 5C:
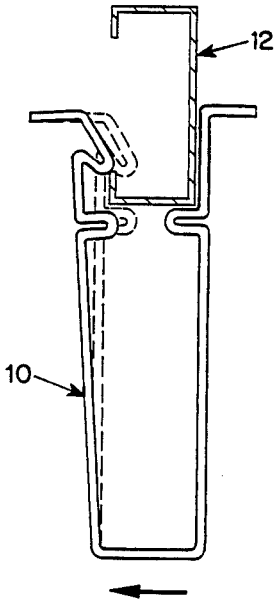

Arms 44 and 45 extend inwardly from the offset portions 40 and 42 and engage, respectively, the external surfaces of the inturned leg part 16*b* and the web portion 14 of the stud. An inturned portion 44*a* on the arm 44 defines a slot 46 that snaps resiliently onto and engages the free edge of the inturned leg part 16*b* of the stud. A divergent camming segment 44*b* extends from the portion 44*a* and urges the legs 36 and 38 of the anchor apart when the anchor is positioned endwise and slightly obliquely to the wall in front of the stud (FIG. 5A) and simultaneously pivoted and pushed inwardly (FIG. 5B), thus allowing the inturned portion 44*a* to slide over the inturned leg part 16*b* and then resile (FIG. 5C) to the installed position (FIG. 1).

As an optional but desirable feature, the anchor 10 includes outwardly turned terminal parts 48 and 49 that impale the fiber batt insulation blankets 24 and hold them in place between the studs.

Loads on the veneer wall 28 directed away from the back-up wall, which are relatively small, are transferred from the veneer wall along the leg 36 and the arm 44 to the free end of the inturned leg part 16*b* at the zone of engagement of the slot 46 with the leg part 16*b*. The wire loop that forms the offset 44 is adequately stiff to carry the tension loads with negligible deformation. Loads on the veneer wall directed toward the back-up wall are transferred by the legs 36 and 38 to the zones of engagement between the offset portions 40 and 42 of the anchor and the external face of the base leg part 16*a* of the stud. The two wire segments forming each offset portion 40 and 42 should be in contact with each other at their lateral extremities (adjacent the junctures with the arms 36 and 38) so that there is no opportunity for deflection of the segments of the offsets.

Figure 3:
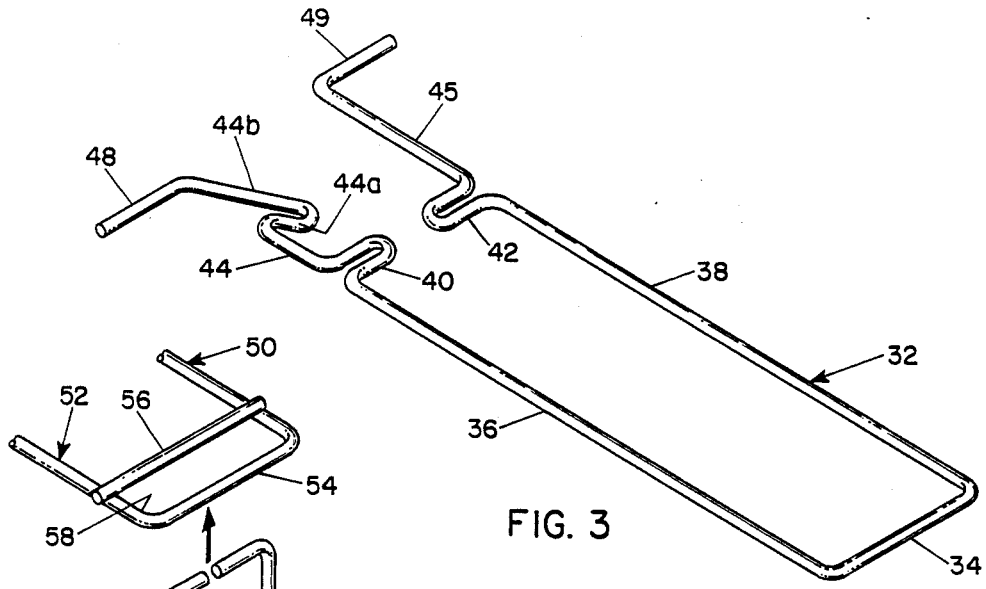
FIG. 3 is a pictorial view of the first embodiment.
Figure 4:
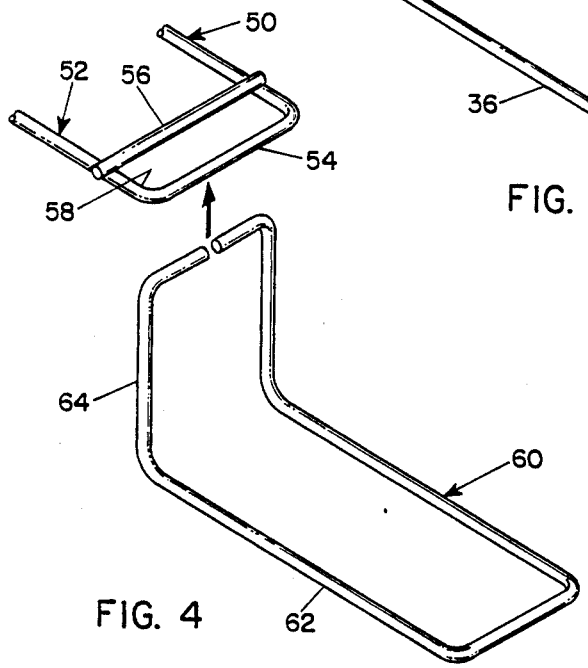
FIG. 4 is a partial pictorial view of a second embodiment.

Another embodiment of the invention, which is shown in FIG. 4, consists of a first member 50 that is similar to the member 10 of FIGS. 1 to 3 except that (1) the U-shaped outer part 52 is shorter such that the base portion 54 engages the inner face of the veneer wall 28 and (2) a rod 56 is welded to the legs of the "U" near the base to provide a slot 58. A second member 60 of the anchor is a rectangular loop of wire bent at a right angle. One portion 62 of the second member 60 is embedded in the mortar joint, and the other portion 64 is received in the slot 58, thereby forming a slip joint. The embodiment of FIG. 4 is useful in veneer walls that have irregularities in the brick work.

I claim:

1. A wire anchor for metal stud/brick veneer wall construction comprising a member bent from metal wire and having a generally U-shaped external portion adapted to span and maintain a space between a stud and a brick veneer wall and a pair of attachment portions adapted to be snapped into a retained position on the stud, which stud includes a web portion and outwardly and inwardly positioned L-shaped flange portions, each having a base leg part and an inturned leg part, each attachment portion of the member being joined integrally to a respective leg of the external portion at a juncture that includes a transverse offset portion engageable with an external portion of the base leg part of the outwardly positioned flange portion of the stud, one attachment portion further including an arm engageable with the external surface of the web portion of the stud, and the other attachment portion including an arm engageable with the external surface of the inturned leg part of the outwardly positioned flange portion the stud and an inturned portion defining a slot adapted to snap resiliently onto and be captured by the edge of the inturned leg part of the outwardly positioned flange portion.

2. A wire anchor according to claim 1 wherein the external portion of the member includes an integral end portion adapted to be embedded in a motor joint of the brick veneer wall.

3. A wire anchor according to claim 1 wherein each attachment portion includes and outwardly turned terminal part adapted to impale and support fiber batting insulation installed between the studs.

4. A wire anchor according to claim 1 and further comprising a second member bent from metal wire, the second member including a portion adapted to be embedded in a mortar joint of the brick veneer wall, and means on the respective said member and said second member forming a vertical slip joint between them.

5. A wire anchor according to claim 4 wherein the slip-joint forming means includes a bar welded to the U-shaped portion of said member to define a slot and leg portions on the second member integral with and bent orthogonally to the embedded portion of the second member and receivable in the slot.

* * * * *